US005259739A

United States Patent [19]

Coates et al.

[11] Patent Number: 5,259,739

[45] Date of Patent: Nov. 9, 1993

[54] NON-RECIPROCATING MULTI-PISTON ENGINE

[75] Inventors: James A. Coates; James M. Gernert, Casper, Wyo.

[73] Assignee: CG&G Enterprises, Casper, Wyo.

[21] Appl. No.: 859,039

[22] Filed: Mar. 27, 1992

Related U.S. Application Data

[63] Continuation-in-part of Ser. No. 719,743, Jun. 24, 1991, abandoned.

[51] Int. Cl.[5] ..... F01C 1/00; F01C 11/00; F01C 17/00

[52] U.S. Cl. ..... 418/1; 418/58; 418/61.2; 418/161; 418/186

[58] Field of Search ..... 418/1, 54, 58, 61.1, 418/61.2, 61.3, 161, 164, 165, 166, 186, 209

[56] References Cited

U.S. PATENT DOCUMENTS

| | | | |
|---|---|---|---|
| 984,904 | 2/1911 | Greene . | |
| 2,988,008 | 6/1961 | Wankel | 418/61.2 |
| 3,115,871 | 12/1963 | Luck | 418/61.2 |
| 3,117,563 | 1/1964 | Wiegert . | |
| 3,285,189 | 11/1966 | Doyer . | |
| 3,322,103 | 5/1967 | Dirnberger | 418/161 |
| 3,340,853 | 9/1967 | Link . | |
| 3,199,496 | 8/1965 | Kell . | |
| 3,141,446 | 7/1964 | Nittka . | |
| 3,964,450 | 6/1976 | Lockshaw . | |
| 4,072,132 | 2/1978 | Lindros . | |
| 4,137,019 | 1/1979 | Hofmann | 418/164 |

*Primary Examiner*—John J. Vrablik
*Attorney, Agent, or Firm*—Gary M. Polumbus

[57] ABSTRACT

A mechanism for providing motive power consisting of a plurality of rotary-type pistons fitted into chambers uniformly situated about the axis of the engine in a housing for improving the effective displacement and compression of such engines. Motive forces generated by the pressure exerted on the piston are transferred from the cylinders through operative pins projecting axially from each of the pistons. The operative pins engage tracks in a guide plates. Due to the shape of the operative pins and tracks in the guide plate, the resultant forces generated between the operative pins and the guide plate cause the housing to rotate relative to the guide plate, generating torque. Thrust layers are provided which have involutes to introduce fuel and other fluids into the piston chambers and to remove exhaust fluids from the chambers. Cover plates are also provided to prevent the introduction and removal of fluids from the chambers from interfering with the transfer of power to the guide plates.

67 Claims, 9 Drawing Sheets

NON-RECIPROCATING MULTI-PISTON ENGINE

CROSS REFERENCE TO RELATED APPLICATION

This application is a Continuation-in-Part of our copending application Ser. No. 07/719,743, filed Jun. 24, 1991, for a Translating Piston, Rotating Chamber Engine, now abandoned.

BACKGROUND OF THE INVENTION

1. Field of the Invention

The present invention relates generally to a non-reciprocating engine of the rotary variety in which a multiplicity of pistons are used to provide motive power.

2. Description of the Prior Art

Historically, engines relying on the Otto cycle, Diesel cycle or other thermodynamic cycles have been constructed in two general classes: reciprocating and rotary.

Reciprocating engines are characterized by translational movement of power producing elements. The power producing elements most commonly consist of one or more pistons, each of which are in the shape of a cylindrical section. One end of the piston is a flat surface and the other is connected to a lever arm which, in turn, is connected to a crankshaft. The pistons are constrained to move within a hollow cylindrical shaft along their common axis. Typically, one end of the cylinder is closed and the flat end of the piston is positioned facing this closed end. In an internal combustion embodiment of the reciprocating engine, valved ports passing through or near the closed end of the cylinder provide a means to permit fluids to pass in and out of the cylinder. The input fluids commonly are comprised of a hydrocarbon fuel and ambient air to facilitate the combustion of the fuel.

In an internal combustion embodiment, fuel and air are introduced through the valved ports into the cylinder and the piston is driven toward the closed end of the cylinder, thereby pressurizing the fuel and air. Power is produced by first detonating the fuel-air mixture. The force produced by the resulting combustion, constrained by the immovable walls of the cylinder, is channeled against the piston, propelling it toward the open end of the cylinder. As a result, the lever arm exerts force on the crankshaft, ultimately providing torque. Through the action of other cylinders and their operative interconnection with the crankshaft, the piston is forced back into the cylinder and the process is repeated to produce continuous motion and torque.

Rotary engines are characterized by rotational motion of the power producing element about the central shaft of the engine. Typical, Wankel-type rotary engines employ pistons, commonly referred to as rotors, which orbit eccentrically about the central shaft of the engine within a chamber. The piston itself is roughly triangularly-shaped, with rounded, convex sides. The vertices of the triangle are capped with seals which maintain contact with the walls of the chamber. The chamber typically has a trochoidal cross-sectional shape. The seals on the piston divide the inside of the chamber into separate regions, each bounded by the walls of the chamber and one face of the piston. The inner volume of the piston has an inwardfacing gear with a larger diameter than the central shaft of the engine. The central shaft has an outward-facing gear enmeshed with the inward-facing gears of the pistons.

In an internal combustion rotary engine, power is produced as a result of combustive force sequentially applied to individual faces of the piston, forcing continuous orbiting of the piston. Four phases take place, generally three of the phases taking place simultaneously: intake/expansion, compression, ignition and exhaust. As the piston orbits, a first piston face will sweep past an intake vent, the orbit of the piston causing the region bounded by the first piston face and the chamber to expand, causing the pressure within the corresponding region of the chamber to be less than that outside the chamber, drawing in ambient air and/or fuel. At the same time, a second, adjacent piston face has just completed intake and the seal at the vertex between the first and second faces now has sealed off this region from the intake vent. The orbit of the rotor causes this second face to move toward the chamber wall, compressing the intake gases, usually air, and fuel. Once this region has been compressed to its minimum volume, the fuel-air mixture contained therein is ignited and the force of the combustion drives this second piston face away from the chamber wall. As a result, the gears on the inside of the piston exert force against the gears on the central axle of the engine, generating torque. The third piston face, having just completed its expansion phase, now sweeps past an output vent. The combustion-generated expansion of the second face causes this third face to be forced against the side of the chamber having the output vent, forcing spent combustion fluids out of the chamber. Once this expulsion is completed, the seal at the vertex between the second and third faces causes this third region to be closed from the output vent just as the region bounded by this third face now opens onto the intake vent, and the cycle begins anew with each 120 degree rotation of the piston.

Both the typical reciprocating and rotating engines suffer from various inefficiencies and methodological defects. The reciprocating engine suffers primarily from five such defects. First, the translational piston movement wastes the displacement capacity of the engine. Engine power is typically a function of its displacement, i.e.. the total volume bounded by the pistons and the cylinders at maximum expansion. In a typical four-cycle engine, for every two cycles of the engine, each piston only performs one power stroke. After a propulsive stroke (through 180 degrees of the engine's cycle), the piston's return stroke is used to expel waste gases from the propulsive stroke (through the remaining 180 degrees of the engine's cycle). In the next expansive stroke, through which the piston is pulled by the engine's crankshaft as the result of force generated by other cylinders, gases and fuel are drawn in for the next cycle and then compressed on the ensuing compressive stroke (requiring another 360 degrees of the engine's cycle). Then the cycle begins anew, once every 720 degrees. Thus, the typical four-cycle reciprocating engine is inefficient because each piston produces power only one fourth of the time.

Second, torque generation in a reciprocating engine is inefficient. The forces resulting from the combustion of fuels within the piston cylinders largely result in the application of stresses to various engine components rather than the production of useful work. As a result of the reciprocating engine's nature, force is exerted by the pistons orthogonally to the central axis of the engine. The greatest force is exerted upon the piston at maximum compression, when the force per unit volume of the detonated fluids is greatest. Unfortunately, it is at this point in the stroke, when the piston is farthest into the cylinder, where the piston's force is directed orthogonally against the shaft of the engine; it is at this point that the moment arm of the piston is at its shortest, thereby delivering the minimum torque per unit force. It is not until halfway through the stroke, when the combustive forces are substantially dissipated and exerting substantially less force on the piston, that the moment arm reaches is maximum length. Thus, in a reciprocating engine, the magnitude of the force has tremendously dissipated by the time the piston arm reaches a point where it is delivering the greatest torque per unit force.

Consequently, much of the force created in a reciprocating engine is wasted as structural stress. Since the greatest force in the reciprocating engine is created when the axis of the piston is perpendicular to the engine's crankshaft, tremendous sheer force is generated and directed against the engine's crankshaft. Further, when the moment arm is at a minimum, so is the rate of piston displacement. As a result, at detonation tremendous stress waves are applied to the chamber, the piston, and the piston rod. Because all the stresses are necessarily being applied at the worst possible time, engine parts must be carefully machined and relatively heavy to be able to withstand the unresolvable stresses.

Third, it should be noted that analogous waste takes place on the compressive stroke as the result of the minimum rate of piston displacement about the point of maximum compression. Because of the relatively slow movement of the piston at maximum compression resulting in relatively slow compression, as a matter of fluid mechanics, the pressurized gases have the greatest tendency to leak through seals between the piston and the chamber, wasting a portion of the engine's power.

Fourth, by their nature, reciprocating engines are necessarily complex. Because the pistons exert a propulsive stroke only once every two revolutions, valve means must be used to control the flow of fuel and combustion gases into and out of the chamber. Obviously, it would be wasteful for combustion gases and fuel to be passively drawn into the cylinder during the expulsive stroke. Accordingly, the valves, typically driven by cams, must be used to direct the engine. The valve means increase complexity, therefore increasing the risk of malfunction, and cost of such engines.

Fifth, it should be noted that the valves also reduce the efficiency of the engine by what commonly are termed breathing losses. The valves necessarily are relatively small because, practically, they must be made to fit within the piston cylinders without obstructing the motion of the pistons. Further, the valves open and close, alternately completely starting and stopping the flow of gases into the engine. Gases, like any other form of matter, create friction and possess inertia. There is fluid friction between the gases flowing through the limited valve openings. Further, periodically halting the flow of air into the mechanism means that it will take some period of time to reaccelerate the gases entering the chamber. As a result, because of the time it takes to reaccelerate the gases, less gas will be introduced into the piston chamber. Because there is less gas introduced into the chamber, the pressure will be reduced and the ultimate combustive force will be diminished.

Rotary engines also suffer from a number of problems, both in efficiency and in structural integrity. From an efficiency standpoint, the displacement and, therefore, the compression ratio, are relatively low, particularly as compared to the size of the piston and chamber. Thus, even though the piston can generate three force strokes per revolution, the strokes are not as powerful as those of a reciprocating engine.

Further, by definition, some of the force generated by the combustion of fluids in the engine is counterproductively applied. The rotary pistons actually straddle the axle to which the inward facing gear of the piston imparts power. Therefore, each face of the piston has a moment arm extending to both sides of the axle. Combustive force is applied to the entire face of the piston. As a result, while force is applied to a portion of the face acting as a positive moment arm to impart positive motion to the piston, force is also applied to the portion of the face straddling the axle on the other side, applying a negative moment to the axle. Thus, the positive torque generated by the rotary engine is partially offset by the inherent negative torque.

Additionally, to make up for the lack of displacement, rotary engines typically have to run faster, thereby running hotter, creating cooling and lubrication concerns. Further, because of the structure of the engine, tremendous stress is exerted not only on the gears of the inner surface of the piston and the engine shaft, but also on the seals at the vertices of the piston. If the seals do not effectively maintain the integrity of the separate regions, power is lost through dissipation, incompletely burned fuels are expelled resulting in emissions problems, and the intake phase does not work efficiently.

One must note both types of engines also suffer from the thermodynamic inefficiency caused by the cooling resulting from the delay between combustive power strokes. The cooling of the piston faces and chamber walls draw energy not only from the combustive phase but also, because of the direct relationship between pressure and temperature in a fixed volume, the pressure which can be generated is reduced in the compression phase of the engine.

The non-reciprocating engine of the present invention has been developed to overcome the deficiencies of prior art engines by generating torque with greater efficiency, reducing stress loading on critical elements and, generally, offering simplicity of design and manufacture.

SUMMARY OF THE INVENTION

The non-reciprocating engine of the present invention incorporates multiple rotary-type pistons, each in its own chamber, which execute multiple, simultaneous rotary cycles about the axis of the engine. In a preferred embodiment the pistons, which do not rotate about their axes but only engage in translational motion, operate within individual chambers formed in a rotor which revolves about the axis of the engine.

Axially projecting from opposite ends of each piston are transfer means comprised of operative pins. First operative pins extend axially from each end of the piston and are eccentrically mounted relative to the axis of the piston. Second operative pins, whose axes are concentric with the axis of the piston, assist in maintaining the piston in proper position. The operative pins are confined in tracks in adjacent receiving means in the nature of guide plates.

Both axial ends of the rotor include integral thrust layers. Involutes formed in the thrust layers extend from the perimeter of the thrust layers to a terminal point radially spaced from the axis of the engine and act as impellers to facilitate the flow of ambient air into the chambers in an intake phase and draw exhaust gases out of the chambers in an expulsion phase of a cycle as an effect of the rotation of the thrust layers about the axis of the engine. The terminal points of the involutes are positioned so as to coincide with the intake and exhaust phases of each piston's motion throughout the cycle.

Fastened across the face of each thrust layer are cover plates which seal the intake and exhaust involutes in the thrust layers along the axis of the engine. Finally, at each end of the engine are attached guide plates having tracks formed therein into which the operative pins of each piston extend. Ultimately, the resultant force between the operative pins and the tracks in the guide plate force the rotor to revolve thereby converting the force created by the combustive strokes of the pistons into torque of the engine.

Other aspects, features and details of the present invention can be more completely understood by reference to the following detailed description of a preferred embodiment, taken in conjunction with the drawings, and from the appended claims.

BRIEF DESCRIPTION OF THE DRAWINGS

The following figures represent the various elements of the present invention.

DESCRIPTION OF THE PREFERRED EMBODIMENTS

Figure 1:
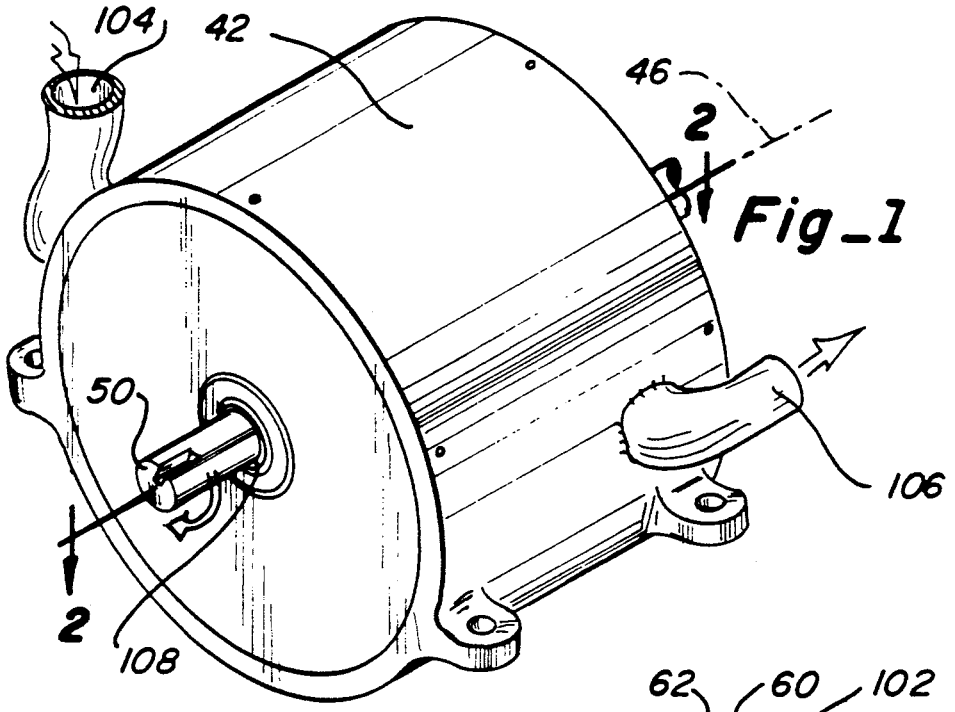
FIG. 1 is an isometric view of the non-reciprocating engine of the present invention.
Figure 2:
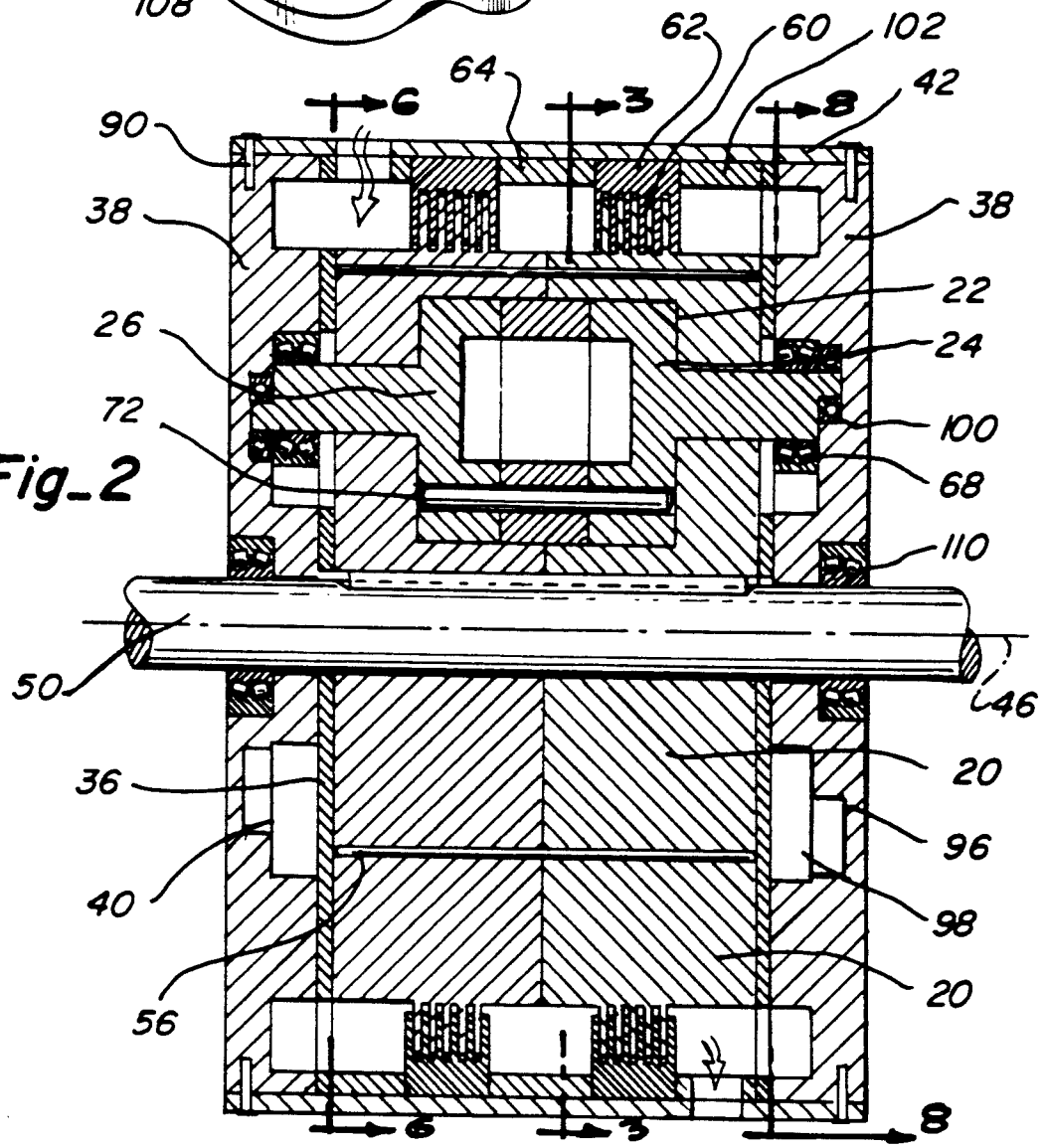
FIG. 2 is an enlarged section taken along line 2—2 of FIG. 1.

The non-reciprocating engine of the present invention, as probably best seen in FIGS. 2, 5A, 5B and 5C, includes a rotor 20 having a plurality of circumferentially disposed chambers 22. Rotary-type pistons 24, are received in each individual piston chamber. Generally, the pistons have a piston head 26 with multiple faces and operative pins 28 and 30 projecting from each end of each piston along the piston's axis. Integral with each axial end of the rotor and forming a part of the rotor are thrust layers 32 having a plurality of involutes 34 formed therein which channel intake and exhaust fluids into and out of the chambers in the rotor. Cover plates 36, which are attached to each thrust layer, axially seal the involutes in the thrust layers. Both the thrust layers and the cover plates allow the operative pins protruding from the ends of each piston to protrude therethrough to a guide plate 38. The guide plates have tracks 40 to accommodate and guide movement of the operative pins protruding from the pistons and the guide plates are positioned at each end of the engine. The assembled operative components of the engine are confined within an outer housing or shell 42. Ultimately, the resultant force generated between the operative pins against the tracks in the guide plates generates the torque of the engine.

The rotor 20 contains the multiple chambers 22 which accommodate the motion of the pistons. The central axis 46 of the rotor is the axis of the engine and the chambers are circumferentially and symmetrically disposed about the axis so that the engine will be kinematically balanced. A keyed opening 48 located at the central axis 46 of the rotor is provided for a keyed drive shaft 50. The keyed opening and shaft rotatably secure the opening and the drive shaft.

The chambers 22, which are cardioid-like in shape, are formed to accommodate motion of the pistons. The shape of each chamber is described by the loci of the points formed by the vertices of the piston head 26 when the piston is prevented from rotating but is allowed to translate in the plane perpendicular to the central axis of the engine as the chamber in which the piston is disposed is rotated about the central axis of the engine. As will be appreciated with the description which follows, the translating movement of the pistons is controlled through operative engagement of the operative pins 28 and 30 protruding from each piston with the tracks in the guide plates 38. The dimensions of the chambers are only minimally larger than this loci of points previously described, allowing only enough of a clearance to permit movement of the piston head within each chamber. Similarly, the thickness of the chambers along the axis of the rotor is only minimally larger than the thickness of the piston heads, thereby allowing only a sufficient minimal clearance to permit movement of the piston heads if the ends of the chambers were sealed flush with the surface of the rotor 20 in the perpendicular plane. The rotor may have any number of chambers about its periphery, but in the disclosed embodiment, three chambers are shown.

Figure 5A:
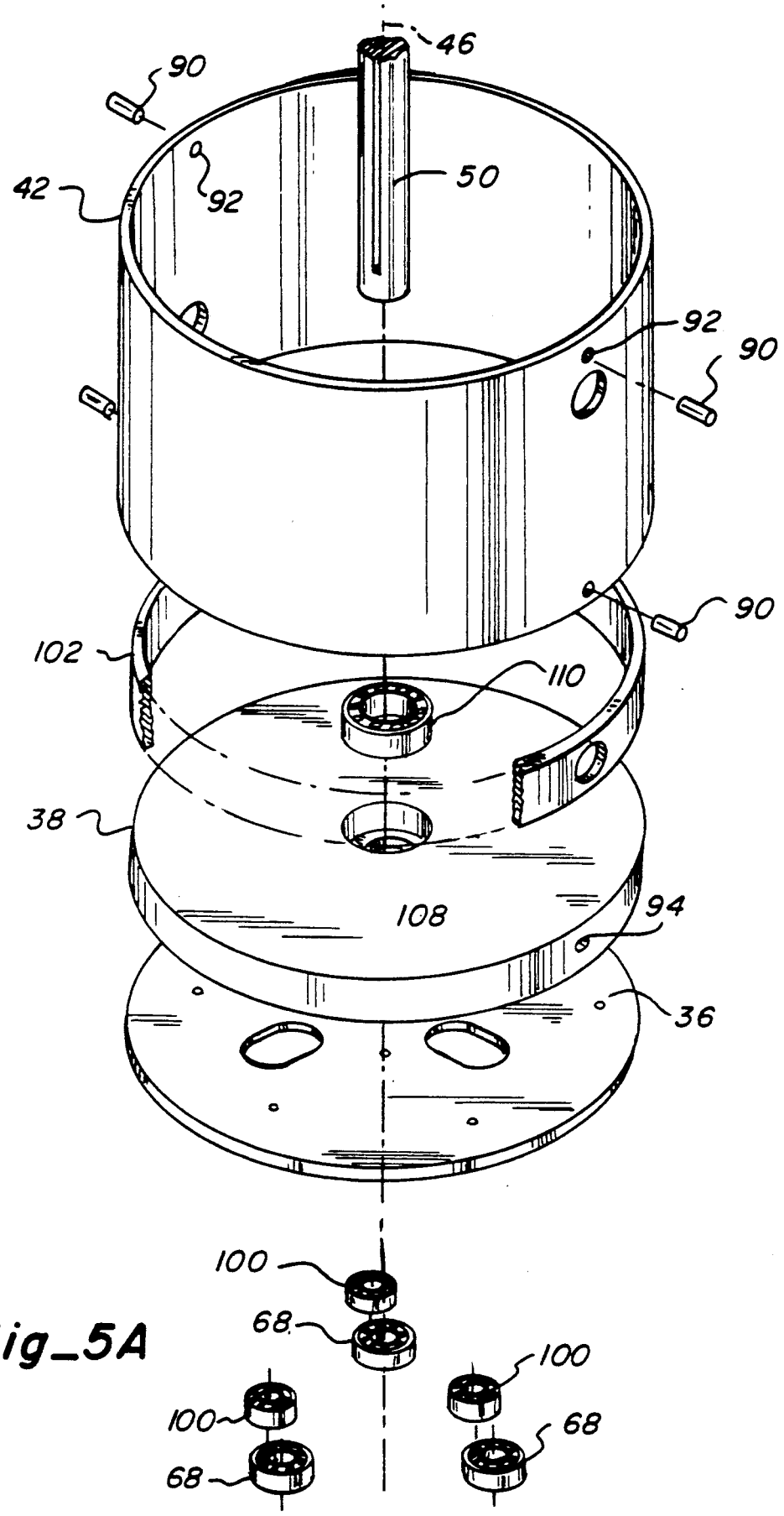
FIGS. 5A, 5B, and 5C are coordinated exploded isometric views illustrating the relative relationship of the various components of the engine of FIG. 1.
Figure 5B:
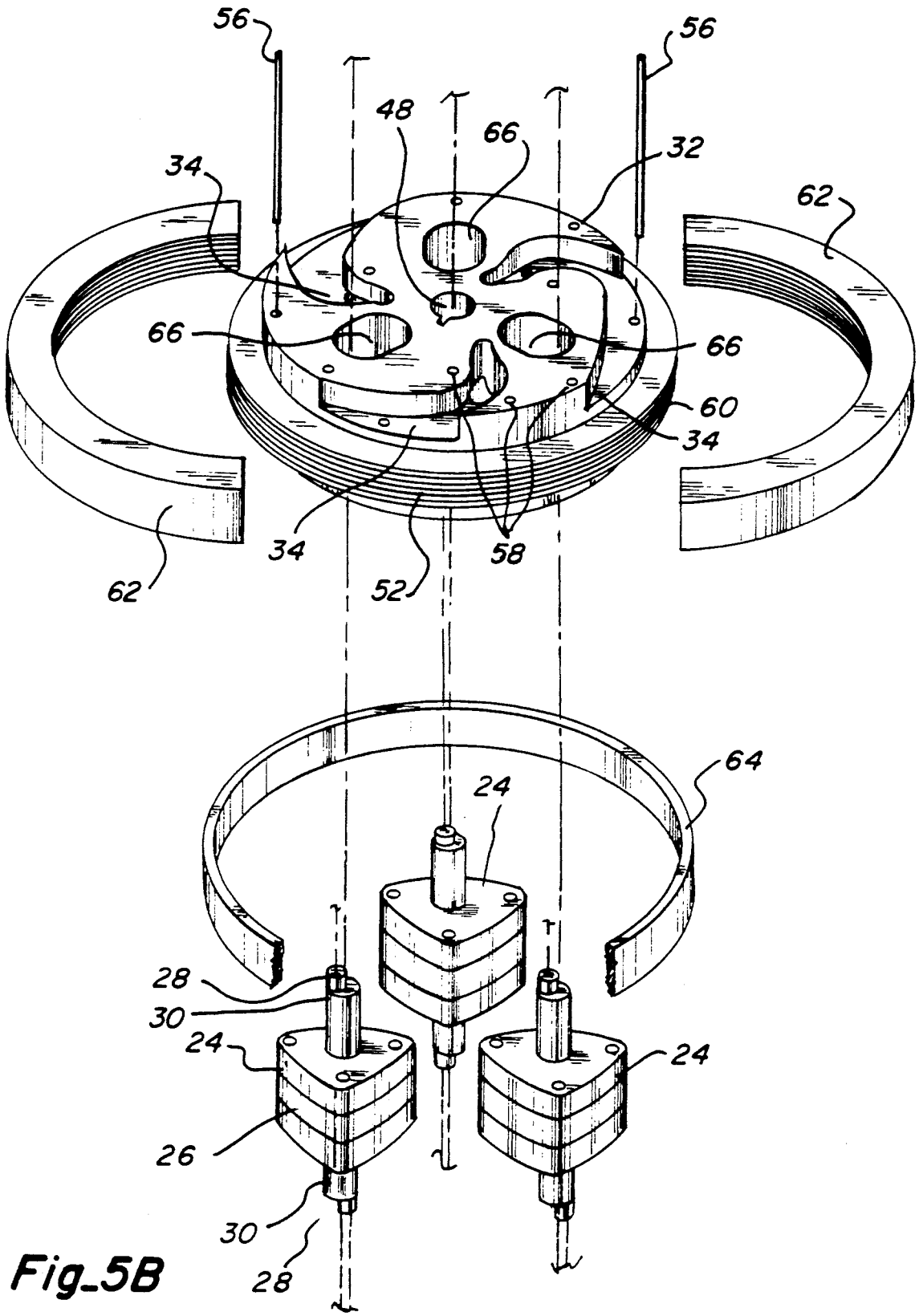
Figure 5C:
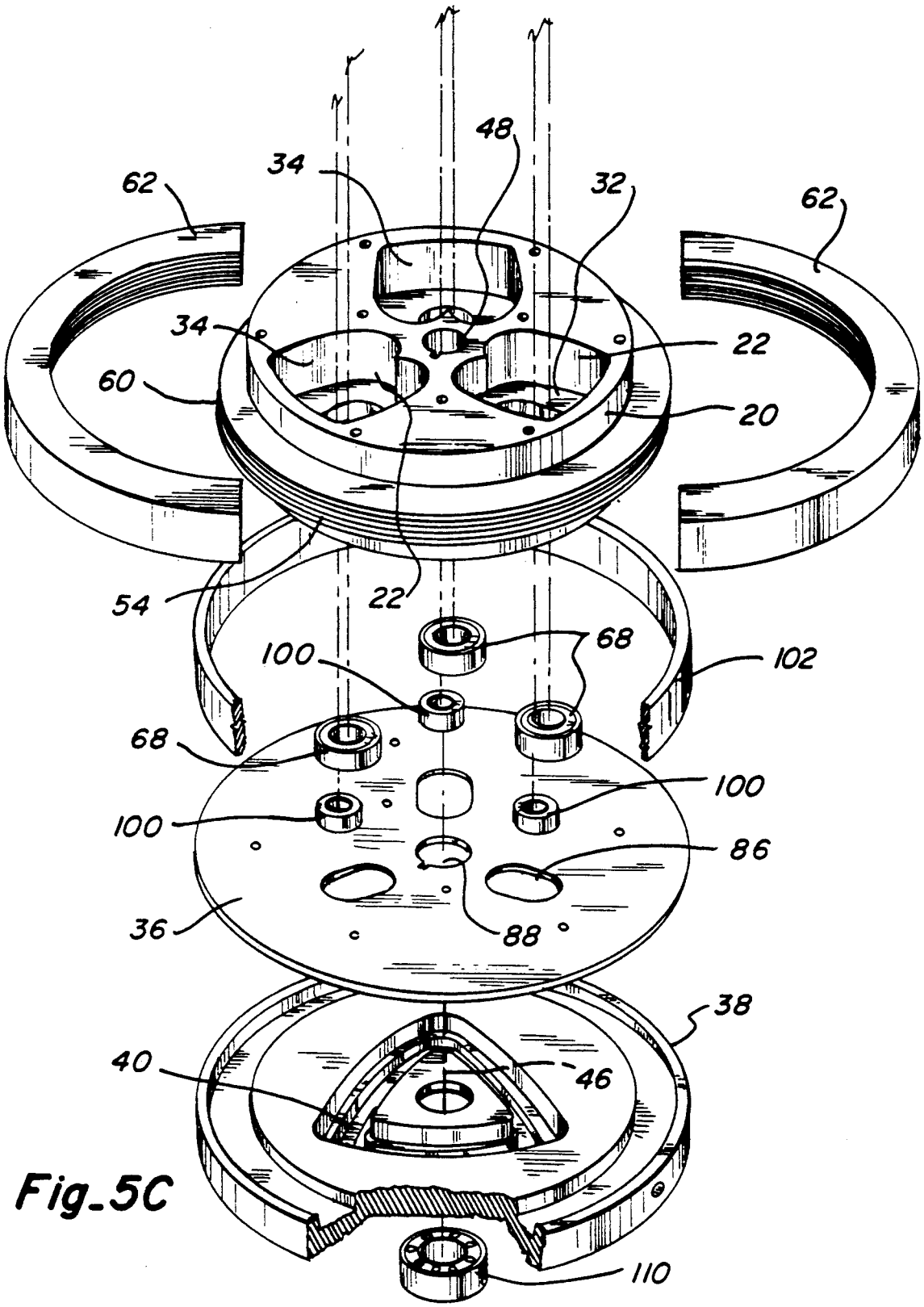

The rotor 20 may be formed in half sections as shown in FIGS. 5B and 5C. As shown, the rotor is comprised of two identical disc-like halves 52 and 54. These halves are positioned with their corresponding faces in which the chambers 22 are formed opposite to each other and are press pinned together by pins 56, which fit in alignable axial passages 58 through the halves. Formed in one face of each half are the piston chambers 22. The thrust layers 32 constitute an opposite face of the halves of the rotor.

On the radially outwardly facing surfaces of each rotor half are five axially spaced ring-like radial protrusions 60. As shown in FIGS. 2, 5A, 5B and 7, the radial protrusions interdigitate with six similar radially inwardly directed ring-like protrusions on semi-circular seal elements 62. There are two sets of the seal elements with the sets being axially spaced and positioned within the housing or shell 42 in alignment with the rotor halves 52 and 54. A ring-like separator 64 also positioned within the housing holds the seal elements in axially spaced relationship. The semi-circular seal elements of each set are adapted to be positioned in confronting engagement to define a completely encompassing ring-like serpentine seal around each rotor half. The serpentine seals segregate intake and exhaust gases which are introduced and expelled by the thrust layers 32. The need for the serpentine seals will be further appreciated with the description of the operation of the device of the present invention as will be detailed below.

The thrust layer portions 32 of the rotor have two sets of openings which overlap to a predetermined degree the chambers recessed in the opposite face of the rotor. The central keyed opening 48 in the rotor will also be seen to extend through the thrust layer portion. One set of openings 66 is provided to permit the operative pins 28 and 30 to extend through the thrust layers while the second set 34 channels intake and exhaust gases into and out of the piston chambers.

As mentioned previously, the thrust layer 32 is an integral part of the rotor halves, such that the thrust layers rotate coincidentally with the rotor 20 about its axis 46. The thrust layers serve as partially enclosing faces to each piston chamber 22. The first set of openings 66 in the thrust layers 32 are ovular in shape and allow the operative pins projecting from each end of an associated piston to pass through the thrust layers. The ovular shape of the openings allows some radial motion of the pistons 24 as the rotor rotates relative to the pistons about the central axis of the engine.

The second set of openings 34, which are somewhat parabolic in shape, taper radially inwardly from a wider end at the perimeter of the thrust layer 32 to a point closer to the center of the thrust layer. The openings act as involutes to introduce and remove ambient gases to the piston chambers 22. Although the thrust layers are identically formed in opposing halves of the rotor, when the halves are assembled, the involutes are diametrically disposed in their orientation and are angularly offset relative to each other. On one face of the rotor 20, the parabolic involutes are shaped so as to be tangentially concave to the rotation of the housing. The apexes of the involutes at this face are situated coincidentally with the space which will open between the piston head and the chamber wall at an intake phase of the engine's operation which is further discussed below. The involutes in this face are shaped so as to create an increased pressure in the involutes relative to the pressure within the piston chambers as the rotor rotates and thereby serve as impellers to force air into the piston chamber.

Conversely, in the thrust layer 32 at the opposing face of the rotor 20, the generally parabolic involutes 34 are shaped so as to be convex to the tangential flow of air about the rotating rotor. The apexes of the involutes are situated coincidentally with the space which will open between the piston head and the chamber wall at an exhaust phase of the engine's operation, again, which is further discussed below. The involutes are therefore shaped so as to create a reduced pressure in the involutes relative to the pressure in the associated chambers and thereby serve as reverse impellers to draw gases away from the chambers in the exhaust phase of the engine's operation.

Figure 4:
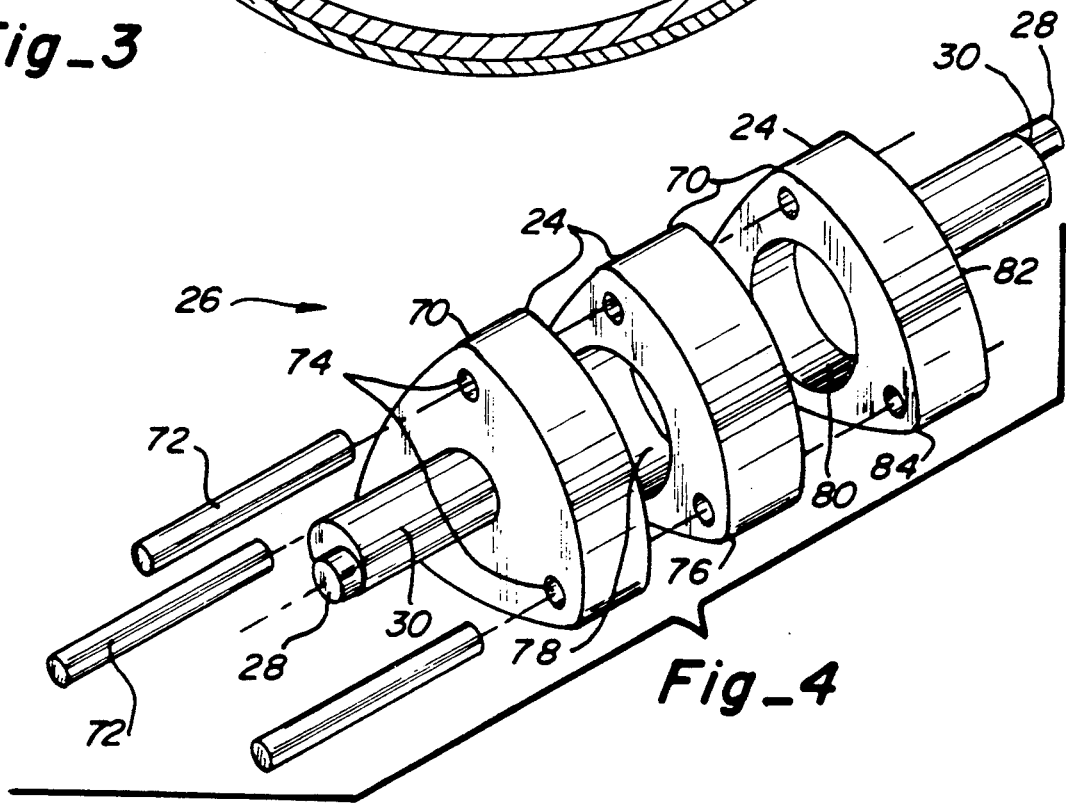
FIG. 4 is an exploded isometric view of a piston used in the engine of FIG. 1.

The pistons 24 as best seen in FIG. 4 each have a main body 26, formed of multiple sections and joined by connecting pins. First and second operative pins 28 and 30 project axially from opposite ends of the main body.

The main body of the piston 26, which may be referred to as the piston head, is formed from three flat segments 70 which are laminated and held together by the connecting pins 72 which are press fit into passages 74 through the flat segments. For weight considerations, the piston head may be hollow. The center segment 76 has a cylindrical hole 78 through its center and the two outer segments have circular recesses 80 in alignment with the circular hole so that when interconnected in a laminated relationship the hole and recesses to define a tubular opening within the piston head.

The transverse cross-section of the piston head 26 is in the shape of an equilateral triangle with arc-shaped sides 82 and vertices 84. The radii of the side arcs necessarily are related to the shape of the piston chambers 22 and will be detailed below. The shape of the rounded vertices is also dependent upon the shape of the chamber, but their radii may be varied as long as the vertices remain in a closely spaced relationship with the side walls of the chamber in which they are disposed to relatively rotate. The axial thickness of the piston head is variable depending upon the desired torque and displacement of the engine. The triangularly-shaped piston heads are reacted against by the expansive forces within the engine chambers which exert forces on the arcuate faces of the piston heads.

Protruding furthest axially from the axial ends of each piston are the first pair of operative pins 28 which are cylindrically shaped. The first operative pins are eccentrically positioned relative to the longitudinal axis of the piston head 26 with the axes of the pins being parallel but not coaxial.

Protruding less far in the axial dimension from each of the opposite ends of the piston head and parallel to the axis of the piston head, is the second set of cylindrical operative pins 30. The axes of the second operative pins are coaxial with the central longitudinal axis of the piston head 26 and have a cross-sectional area which is less than that of the piston head so that the second operative pins are completely enclosed within the cross-sectional area of the piston head. The cross-sectional area of the second operative pins completely contain the cross-sectional area of the first operative pins 28.

In the preferred embodiment, the relationship between the opposing ends of the piston is such that if the piston 24 were split perpendicularly to its longitudinal axis and the halves viewed side by side, the eccentrically-mounted first operative pins 28 could be oriented such that the half-segments would appear identical. As a result, the pistons could be manufactured in identical sections. When the pistons are pinned together, however, the first operative pins 28 are optimally oriented at 180 degree angles relative to each other, although any relative angular disposition between the first operative pins on opposite ends of the piston head 26 will allow the engine to function as described. As will be appreciated with the description of the engine and its operation later, the eccentric positioning of the first operative pins allows the relative rotation of the pistons and the rotor 20 to be controlled through transverse forces applied at opposing ends of the piston.

Cover plates 36 are attached in any suitable manner to each thrust layer in axially overlying relationship therewith. The cover plates contain two types of openings, one set of openings to permit the operative pins to extend through the cover plate and another to allow the drive shaft of the engine to pass through.

A cover plate 36 is attached to each end of the rotor and rotates in unison therewith. Like the first set of openings in the thrust layer, the cover plates contain ovular openings 86 coincident with those in the thrust layer to permit the operative pins on the piston to pass through the cover plates. Unlike the thrust layers, however, the cover plates are closed along their circumference. As a result, the involutes in the thrust layers are closed and sealed in the axial direction of the engine by the cover plates. The cover plates have the same cross-sectional area as the rotor. Each cover plate also contains a central keyed opening 88 which allows the drive shaft of the engine to protrude through the cover plate.

Guide plates 38 are positioned at opposite axial ends of the engine and have formed in inwardly directed faces thereof tracks 40 to accommodate the operative pins 28 and 30 protruding from the pistons 24. It is the resultant interactive forces between the operative pins and the tracks in the guide plates which cause the rotor to rotate, thereby generating torque for the engine.

Unlike the thrust layers and cover plates, the guide plates 38 are not attached to the rotor 20. Rather, the guide plates are pinned to the outer cylindrical housing or shell 42 of the engine by pins 90 press fitted into aligned holes 92 in the housing and radial recesses in the guide plates 94. The guide plates contain a pair of identically shaped, although not identically dimensioned tracks 96 and 98. The tracks, which are laterally offset relative to each other, guide and confine the operative pins 28 and 30 protruding from the pistons 24. The tracks themselves are similar in shape to the pistons heads, formed generally in triangular shapes but having rounded sides and vertices.

Figure 8:
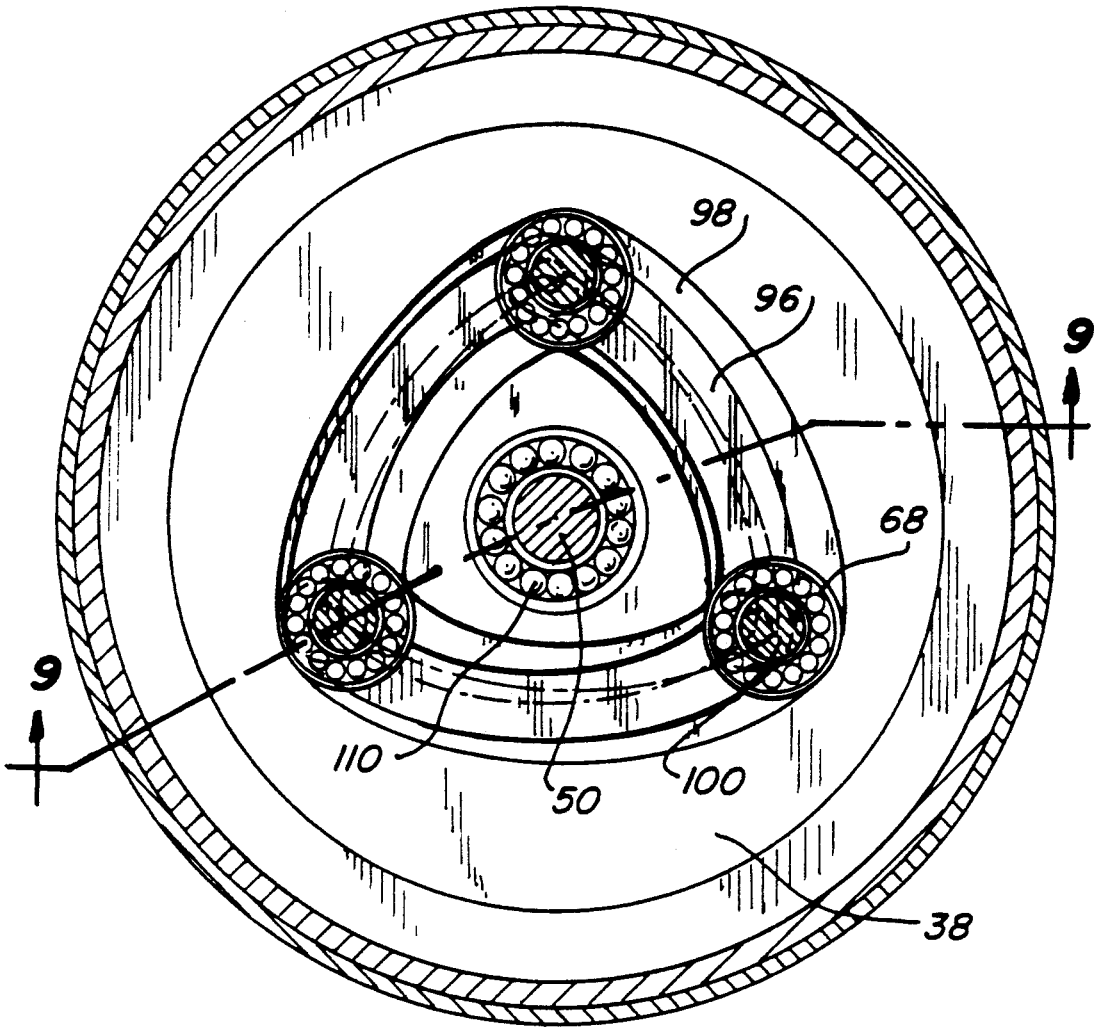
FIG. 8 is a section taken along line 8—8 of FIG. 2.

A second track 98 is relatively wide and shallow and is concentric with the longitudinal axis of the engine. The first track 96 is formed in a bottom surface of the first track and is relatively narrow compared to the first track and laterally offset. The first track must only be laterally offset, not angularly offset, to the second track. In other words, as probably best appreciated by reference to FIG. 8, the relatively narrow track is shifted purely laterally as viewed in FIG. 8 so that the innermost edge of the relatively narrow first track 96 along the upper right-hand leg, again as viewed in FIG. 8, is substantially coincident with the inner edge of the relatively wide second track 98. Accordingly, and as described previously, while the tracks themselves are identical in configuration, i.e., have an identically sized and shaped center line, the lower relatively narrow track has been laterally offset so as to be eccentric relative to the central axis 46 of the engine.

Figure 9:
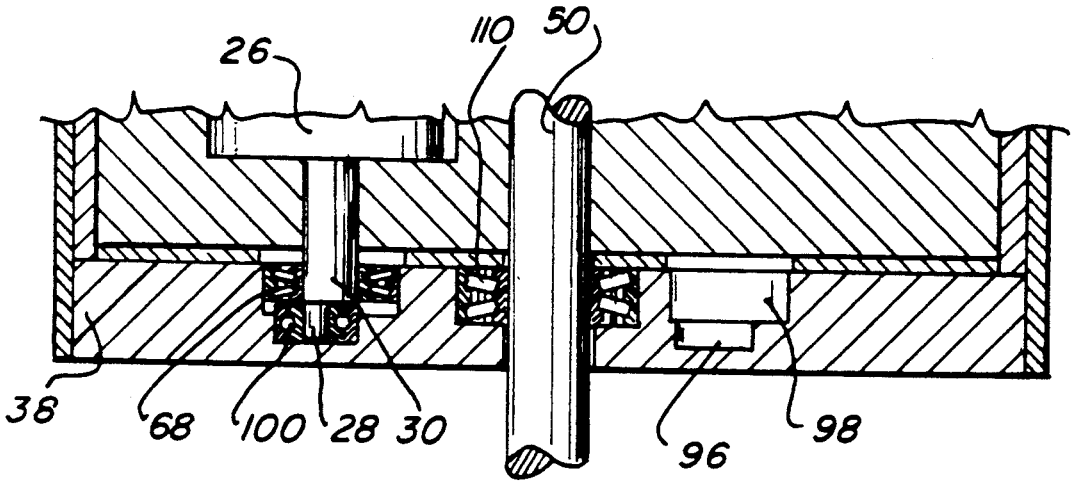
FIG. 9 is a fragmentary section taken along line 9—9 of FIG. 8.

As is probably best appreciated by reference to FIGS. 8 and 9, it will be appreciated that the second set of operative pins 30 on each piston are of a length to protrude only into the relatively wide, upper second track 98 and have roller-type bearings 68 press fitted thereon. The outer diameter of the bearings provide a close tolerance fit with the upper track so that the first set of pins are confined and guided by the upper track as the rotor of the engine rotates. As will be recalled, the first set of pins are concentric with the longitudinal axis of the pistons 24 also are confined within the concentric tracks of the guide plates 38.

The first set of operative pins 28 which are eccentrically mounted on each piston 24 protrude into the relatively narrow first 96 track and also have bearings press fitted thereon which are of a close tolerance fit within the lower relatively narrow first track 96. Again, as will be recalled, the first set of eccentric pins are therefore disposed within and guided by the eccentric track as the rotor 20 of the engine rotates relative to the guide plates.

The confinement of the eccentric operative pins 28 on each piston within the eccentric track 96 of the associated guide plate 38 serves to retain the associated piston in a fixed angular orientation as the rotor rotates thereby establishing a relative rotational relationship between the piston and the chamber in the rotor within which the piston is disposed. The second set of operative pins 30 on each piston through interaction with the shallow, relatively wide guide track serves to transfer forces created by explosive forces in the chambers 22 of the rotor 20 against the sides of the pistons 24 in a manner to be described in more detail later. In other words, the eccentric pins on each piston serve to retain a fixed angular position of the associated piston even though the piston is being translated relative to the engine housing or shell 42 by the guided movement of the piston in a substantially triangular track by rotation of the rotor and the concentric, second operative pins 30 transmit force to the track 98.

As stated previously, the dimensions describing the sides of the pistons, the shapes of the guide tracks and the shape of the piston chambers are interrelated. Once the desired performance characteristics, i.e., displacement and torque, of the engine are chosen, the necessary parameters can be determined by solving a system of determinative parametric equations derived from the interrelationships of the previously described components.

As previously indicated, the axial thicknesses of the rotor and the pistons are predetermined by the displacement and torque desired from the engine. A radius of the engine, R (FIG. 3), and the lateral width of the faces of the pistons, W, also are predetermined by both the displacement and torque needed from the engine as well as by the structural strength of the materials chosen for the engine. The width of the piston faces, W, must be large enough to permit the desired displacement but small enough such that the size of the piston chambers is not so large as to undermine the structural integrity of the rotor by overly minimizing the thickness and strength of the walls of the rotor.

Figure 3:
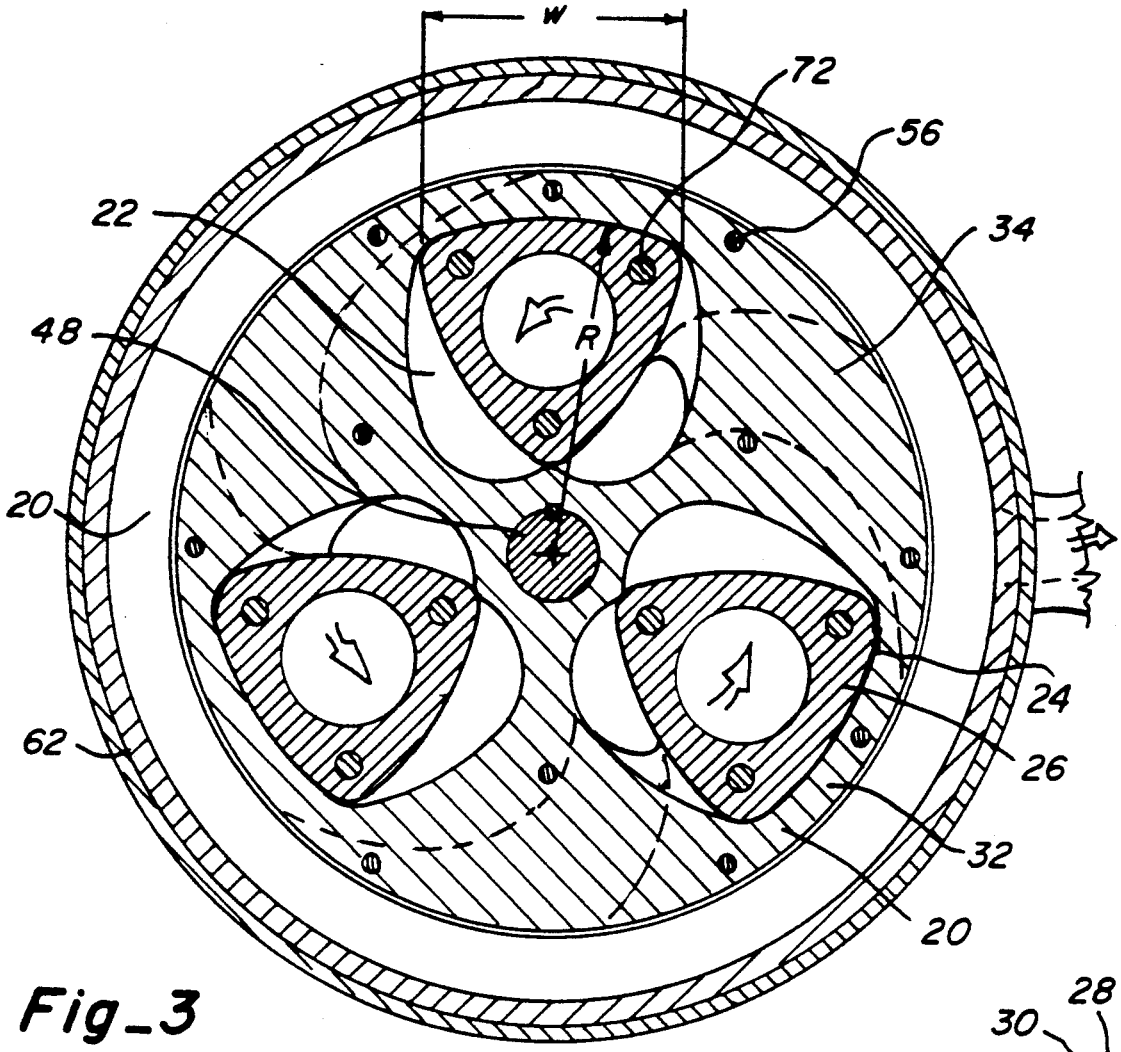
FIG. 3 is a section taken along line 3—3 of FIG. 2.

The radius R of the engine is defined as the distance from the central axis of the engine to the outermost inner surface of one of the piston chambers, as is shown in FIGS. 3. Both the outermost inner surface of the piston chambers and the faces of the piston heads are defined by arcs whose arc radii are equal to the radius of the engine.

Figure 11:
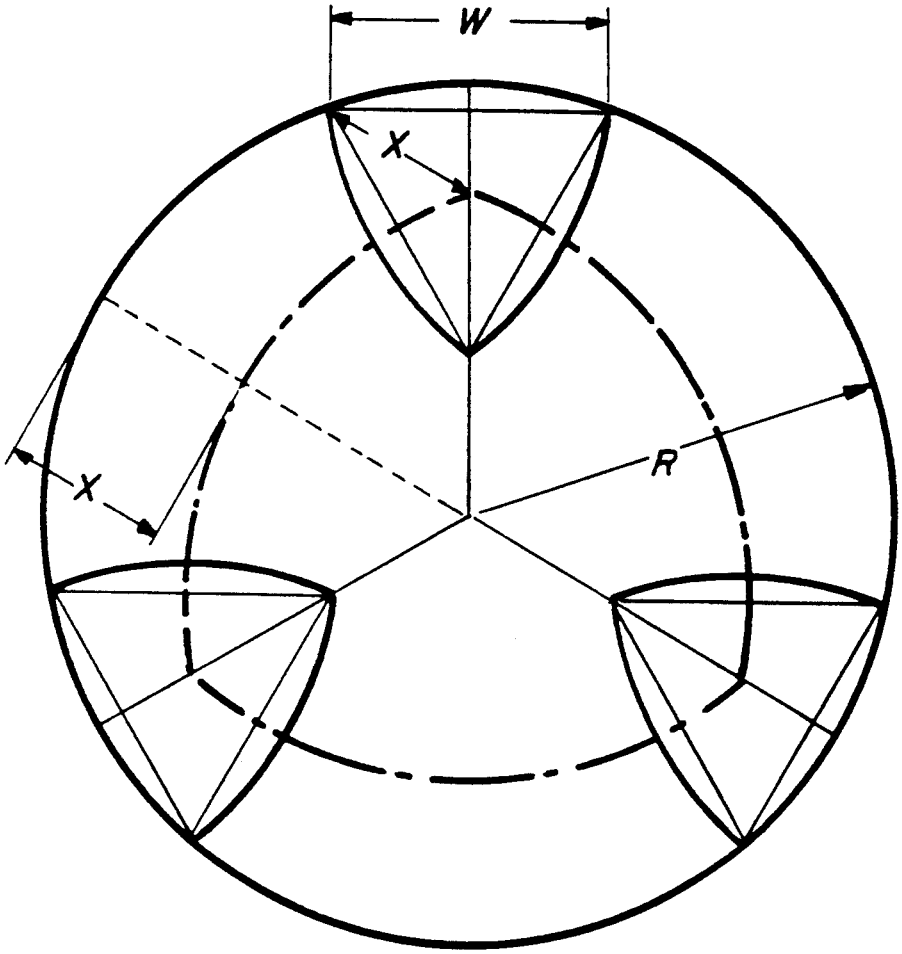
FIG. 11 is a schematic drawing illustrating the determination of the center line of the tracks formed in the guide plates of the engine.

The shape and size of the center lines of the tracks in the guide plate generally are determined by the locus of the points described by the center of the equilateral triangle defined by the vertices of the piston heads as the triangle is revolved 360 degrees about the central axis of the engine without allowing the triangle to rotate as shown in FIG. 11. This is probably better understood by creating a circle of radius R (FIG. 11) and a triangle having sides of length W and moving the triangle around the circle without changing the triangle's angular orientation such that at least one of the vertices of the triangle is always is contact with the circle of radius R. Because the triangle is not rotated about its axis, every 120 degrees two of the triangle's vertices will contact the perimeter of the circle and another of the vertices will then remain in contact with the circle through the next 120 degrees of motion.

As can be seen in FIG. 11, the greatest distance that the center line will be from the perimeter of the circle is X, the distance from the center of the triangle to one of its vertices. This occurs in the movement of the triangle around the circle when a vertex of the triangle is in contact with the circle and the center of the triangle, the vertex and a radius of the circle are colinear.

The tracks 96 and 98 themselves, whose inner and outer boundaries are of equal shape and parallel, are approximately the width of the operative pins which they accommodate allowing for the width of the bearing means securely fit to the pins to facilitate the movement of the pins within the tracks. The tracks 98 accommodating the second operative pins 30, therefore, would have a width greater than that of the tracks 96 formed for the first drive pins 28. As stated it is the motion of the second operative pins and the force they exert against the tracks in the guide plate that generate the engine's torque. Also as stated, to ensure that the pistons translate but do not rotate as they orbit the central axis of the engine, the track accommodating the first operative pins is laterally offset such that the tracks are not coaxial with each other.

To assemble the engine, first the pistons 24 are assembled by connecting the piston segments 70 with the connecting pins in the previously described press-fit relationship. The pistons are then inserted into the chambers 22 of the rotor 20. Note that as the pistons are inserted into the chambers, they should be rotated within their respective chamber such that the second concentric pins 30 fit through the ovular openings 66 in each thrust layer 32. On each axial end of the rotor outside each thrust layer, a cover plate 36 is placed outside the thrust layer to seal the involutes in the axial dimension. The ovular openings in the cover plate 36 are situated to accommodate the concentric second pins protruding from each piston. The halves of the rotor 52 and 54 and the cover plates 36 are also assembled in a press-fit relationship, secured by the connecting pins 56. The semicircular seal elements 62 are then interdigitated with the ring-like radial protrusions on the rotor 60 after the central spacer ring 64 is positioned therebetween. The second bearing means 68 are applied to the second operative pins 30 and the first bearing means 100 are applied to the first operative pins 28. Finally, the guide plates 38 are applied to one or both ends, rotating the eccentrically mounted first operative pins on each end of each piston to fit them into their respective tracks 96 in the guide plates. The entire mechanism is then inserted into the housing 42, along with the two outer spacing rings 102 and the guide plates are secured to the housing via the pins 90 in a press-fit relationship.

As assumed for purposes of this detailed description, the guide plates are fixed and torque is derived from the rotation of the rotor. In the disclosed embodiment, the engine is manifested as an auto-ignited/Otto cycle engine with the operative components sealed within the housing. The housing has three types of openings therethrough. An intake manifold 104 (FIG. 1) allows an air-fuel mixture to be induced into the engine. An exhaust manifold 106 allows exhaust fluids to be jettisoned from the engine. Axially-aligned drive shaft openings 108 are provided to allow the drive shaft of the engine to pass through this otherwise sealed closure. The guide plates themselves may form the non-rotating axial ends of this housing, providing an aperture for the drive shaft large enough to accommodate both the shaft and whatever bearings means 110 are used to permit rotation of the shaft.

In the invention of the present application, power is produced as a result of expansion of fluids within the piston chamber sequentially apply force to individual faces of the piston, forcing continuous orbiting of the piston. As the rotor rotates about the central axis and the piston orbit about the central axis of the engine without rotating, a first piston face will sweep past an intake vent and undergo an intake phase. The relative movement between the piston head and the inner surfaces of the piston chamber cause a region bounded by the first piston face and the chamber to expand, causing the pressure within the region of the chamber to be less than that outside the chamber, drawing in ambient fluids. At the same time, a second, adjacent piston face has just completed the intake phase and the relative movement between the piston and the inner surface of chamber causes this second face to move toward the chamber wall, compressing the intake gases in a compression phase. Once this region has been compressed to its minimum volume, the compressed fluids are caused to expand, typically by igniting the compressed fluids. The force of the combustion drives the second piston face away from the chamber wall in an expansion phase. The force caused by this expansion, limited to translational movement by the first operative pins, is transmitted through the first operative an exerted against the corresponding track in the guide plates. As a result of the reactive force between the first operative pins and the guide plates, the torque of the engine is generated. Finally, the third piston face, having just completed the expansion phase, now sweeps past an output vent. The relative motion between the third face and the inner surface of the piston chamber causes this third face to move toward the inner surface of the piston chamber, forcing spent expansion fluids out of the chamber. Once this expulsion is completed, the relative movement between the piston and the inner surface of the piston chamber this third region to be closed from the output vent just as the region bounded by this third face now opens onto the intake vent, and the cycle begins anew with each 120 degree rotation of the piston.

Figure 6:
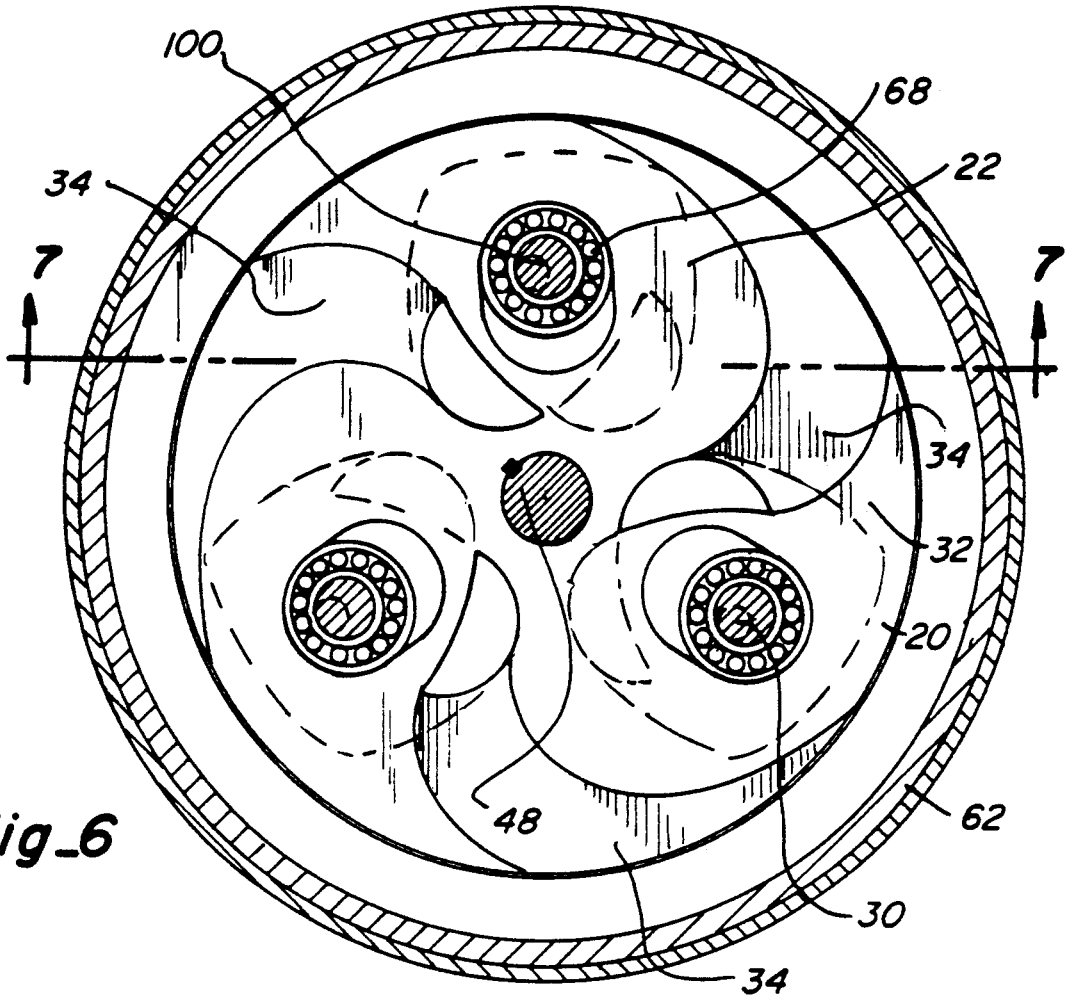
FIG. 6 is a section taken along line 6—6 of FIG. 2.
Figure 7:
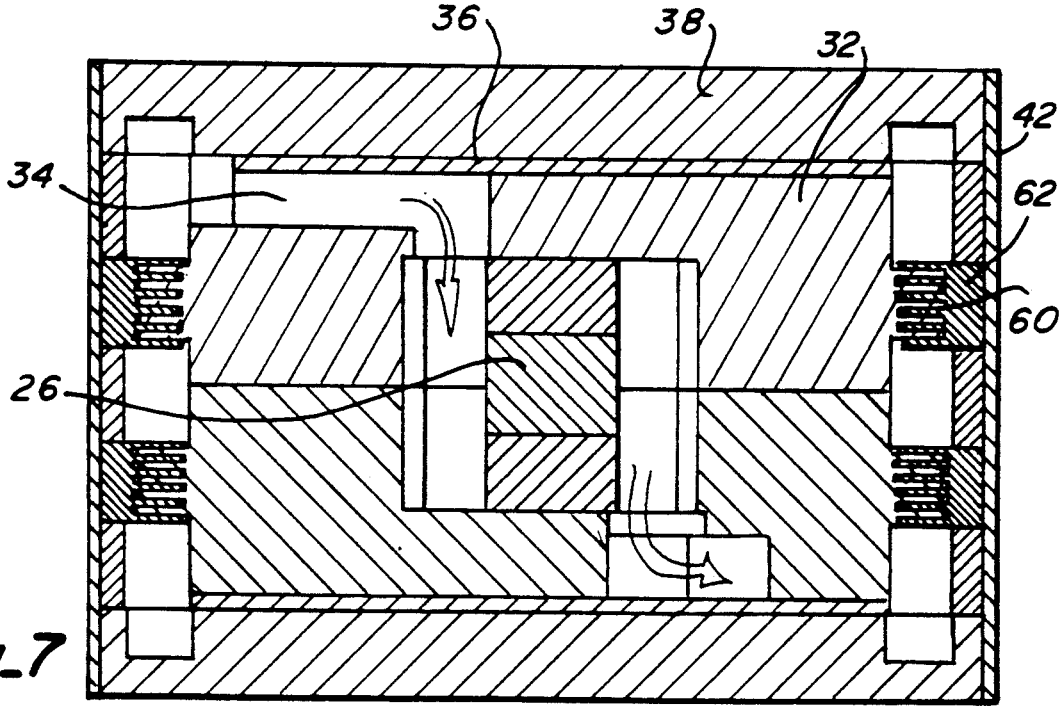
FIG. 7 is a section taken along line 7—7 of FIG. 6.
Figure 10A:
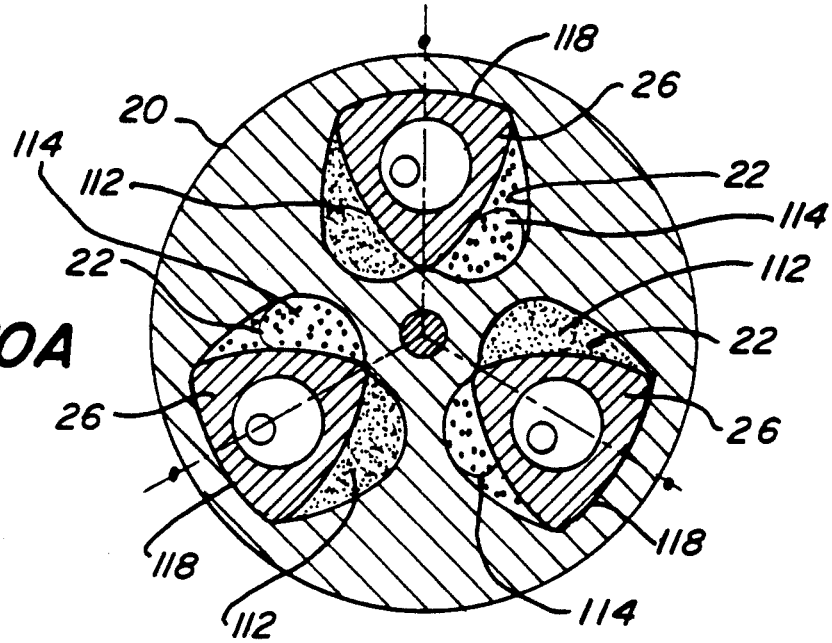
FIGS. 10A, 10B, and 10C are operational diagrammatic views illustrating the relative relationship of the pistons to the piston chambers through a 60-degree revolution of the engine.
Figure 10B:
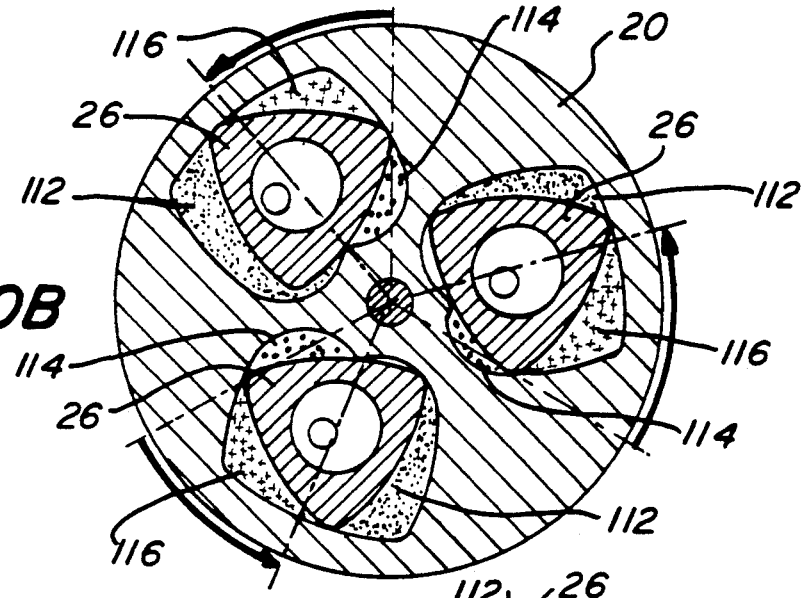
Figure 10C:
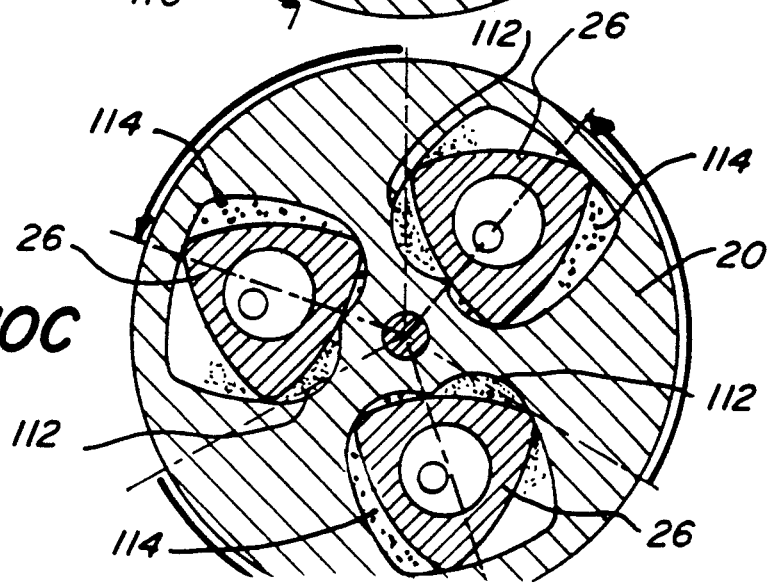

For the sake of illustration, assuming an internal combustion auto-ignited/Otto cycle engine having fixed guide plates and a rotating rotor, FIGS. 10A-10C represent the operation of the mechanism of the present invention through 120 degrees of motion, 40 degrees at a time. First, the fuel air mixture is drawn through the manifold by the involutes on the axial end of the engine where the involutes are tangentially concave to the rotation of the rotor, and ultimately into an intake region 112 (FIGS. 10A-10C) of the piston chamber, as is depicted in FIGS. 6 and 7. Looking at FIG. 10A through 10C, motion is generated when the spontaneous combustion of the fuel-air mixture occurring at the outermost region of the piston chamber 118 forces expansion of the volume of the expansion region bounded by a first face of the piston head and the outer chamber wall, 116. In the frame of reference depicted, the piston Will undergo translational motion to accommodate the expansion of the combusting fluids. The eccentric track in the guide plate in contact with the eccentrically-mounted first set of operative pins projecting from the pistons prevent the pistons from rotating in this expansion phase. Consequently, in order to translate to allow expansion of the combusting gases, translational force is applied where the second set of operative pins engage the guide tracks, causing the piston housing to revolve.

As the rotor rotates, the previously combusted fluids in the next most clockwise region, 114 (FIGS. 10A-10C), of the chamber are displaced. The spent gases are driven out through the involutes in the thrust layer at the opposite axial end of the housing and eventually out the exhaust manifold in the housing. On the other hand, in the next clockwise region 112 intake gases recently drawn in from the involutes begin to become compressed as the fluid in this region is swept towards the combustive region of the piston chamber 118 and the cycle begins anew.

It Will be appreciated by viewing FIGS. 10A through 10C that the asymmetric shape of the piston chambers in this embodiment generates an asymmetric rate of compression/expansion taking place in each region of the piston chamber. Expansion increases most rapidly immediately after detonation and much more rapidly than the linear rate of expansion derived from reciprocating engines (which is inhibited by the lever arm's orthogonal orientation to the crankshaft at maximum compression). Because this mechanism enables such rapid expansion, fuels which burn very quickly could be employed in this engine, whereas such fuels would be wasted in a typical reciprocating engine because of the relatively slow rate of post-ignition expansion attendant in such systems. This fact is particularly significant because fast-burning fuels typically produce significantly less pollutants than slower-burning fuels.

Similarly, the shape of the chamber causes compression to be accelerated at the end of the compression cycle. As a result, compression takes place relatively quickly. The faster the rate of compression, as a matter of basic fluid mechanics, the lower will be the gas losses through openings between components in the mechanism.

Consequently, because of the high rate of compression, as well as expansion, and the commensurately reduced gas losses, not only is the engine rendered more efficient, but the relative importance of seals around the vertices and sides of the piston heads is reduced, potentially trivialized or even eliminated.

Further, not only is the importance of seals minimized, thereby exhibiting a substantial improvement over ordinary rotary engines, but the mechanism generally has very few parts. Unlike a reciprocating engine, there are no valves, cams, lever arms, swiveling pins in the piston heads, specially shaped crank shafts, etc.

It must also be noted each piston, as in a conventional rotary engine, completes one combustive force cycle as each face of the piston sweeps through 120 degrees of revolution. Assuming an embodiment of three pistons and chambers arrayed about the central axis of the engine in a rotating chamber housing, three combustive force strokes are completed as the housing sweeps through each 120 degrees of motion, for a total of nine combustive force strokes being completed in each full revolution of the housing. Therefore, the effective displacement is nine times the volume bounded by each piston and its chamber at full extension from the chamber wall, as compared to three times that same area for a conventional rotary engine. The difference is more dramatic as compared with a reciprocating engine. In a conventional four-cycle reciprocating engine, the effective displacement is only one fourth that of each cylinder because each piston completes a combustive stroke during half the cycle per every two revolutions of the engine. Thus, the effective displacement per unit volume for the non-reciprocating engine of the present invention is six times that of a reciprocating engine.

Because of the number of combustive strokes per revolution, the invention of the present application also has the advantage of reduced cooling between combustive strokes as compared to conventional reciprocating engines. This improves the thermodynamic efficiency of the engine by maintaining a higher temperature; operating at a consistently higher temperature, more pressure will be generated on compressive strokes and less energy will be lost to heating on combustive strokes.

In sum, the mechanism of the present invention is efficient, structurally sound without inherent structural concerns derived from its methodology, and elegantly simple in design.

Although the present invention has been described with a certain degree of particularity, it is understood the present disclosure has been made by way of example, and changes in detail or structure may be made without departing from the spirit of the invention as described in the appended claims.

We claim:

1. A non-reciprocating engine mechanism comprised of:

a housing, a rotor mounted in the housing for rotation about a longitudinal axis, said rotor having an output shaft operatively connected thereto, and at least one piston chamber, a piston disposed in said chamber, said piston having a central axis parallel to said longitudinal axis, said piston being translatable in a plane perpendicular to said longitudinal axis while maintaining a constant orientation in said plane as the rotor is rotated about said longitudinal axis, transfer means operatively associated with said piston and said output shaft for transmitting force to said output shaft, and fluid delivery means in said housing for delivering a motive fluid to said chamber such that said fluid will effect relative motion between said piston and said rotor.

2. The apparatus of claim 1 wherein the transfer means associated with each piston consist of at least one operative pin projecting axially from each piston head.

3. The apparatus of claim wherein an axis passing perpendicularly through a central point on a transverse cross-section of a first operative pin is parallel to but not coaxial with the central axis of the piston.

4. A non-reciprocating engine mechanism comprised of:

a housing, a rotor mounted in the housing for rotation about a longitudinal axis, said rotor having an output shaft operatively connected thereto being coaxial with said longitudinal axis, a radial periphery and a plurality of piston chambers, a plurality of pistons disposed in said chambers, said pistons being translatable in a plane perpendicular to said longitudinal axis while maintaining a constant orientation in said plane as the rotor is rotated about said longitudinal axis, transfer means operatively associated with said pistons and said output shaft for transmitting force to said output shaft upon relative motion between said pistons and said rotor, and fluid delivery means in said housing for delivering a motive fluid to said chambers such that said fluid will effect relative motion between said pistons and said rotor.

5. The apparatus of claim 4 wherein the housing has at least one opening allowing the output shaft to pass through the housing.

6. The apparatus of claim 4 wherein each piston has a plurality of lateral surfaces meeting at an equal plurality of vertices to define a piston head.

7. The apparatus of claim 6 where the lateral surfaces of each piston have an arcuate cross-section.

8. The apparatus of claim 6 wherein the transfer means associated with each piston consist of at least one operative pin projecting axially from each piston head.

9. The apparatus of claim 8 wherein there is a first operative pin and an axis passing perpendicularly through a central point on a transverse cross-section of said first operative pin is parallel to but not coaxial with the central axis of the piston.

10. The apparatus of claim 4 wherein said rotor rotates relative to the longitudinal axis of said output shaft.

11. The apparatus of claim 10 wherein said plurality of piston chambers is circumferentially disposed about said output shaft.

12. The apparatus of claim 4 wherein said piston chambers each have arcuate inner surfaces.

13. The apparatus of claim 12 wherein a radially outermost arcuate inner surface of the piston chamber have an arc radii equal to a distance measured along a radius form the longitudinal axis of the output shaft to a point on the radially outermost arcuate surface of one of the piston chambers.

14. The apparatus of claim 4 wherein said fluid delivery means includes a thrust means positioned on an axial end of the rotor.

15. A non-reciprocating engine mechanism comprised of:

a housing, a rotor mounted in the housing for rotation about a longitudinal axis, said rotor having an output shaft operatively connected thereto being coaxial with said longitudinal axis, a radial periphery and a plurality of piston chambers, a plurality of pistons disposed in said chambers, transfer means operatively associated with said pistons and said output shaft for transmitting force to said output shaft upon relative rotation between said pistons and said rotor, and fluid delivery means in said housing for delivering a motive fluid to said chambers such that said fluid will effect relative rotation between said pistons and said rotor, wherein said fluid delivery means includes a plurality of openings in said rotor through which motive fluids are introduced to and removed from said chambers.

16. A non-reciprocating engine mechanism comprised of:

a housing, a rotor mounted in the housing for rotation about a longitudinal axis, said rotor having an output shaft operatively connected thereto being coaxial with said longitudinal axis, a radial periphery and a plurality of piston chambers, a plurality of pistons disposed in said chambers, wherein each piston has a plurality of lateral surfaces meeting at an equal plurality of vertices to define a piston head and the lateral surfaces of each piston have an arcuate cross-section represented by an equilateral triangle have arcuate sides and having a central axis passing through the center of said cross-section, said central axis being parallel with the longitudinal axis, transfer means operatively associated with said pistons and said output shaft for transmitting force to said output shaft upon relative rotation between said pistons and said rotor, and fluid delivery means in said housing for delivering a motive fluid to said chambers such that said fluid will effect relative rotation between said pistons and said rotor.

17. A non-reciprocating engine mechanism comprised of:

a housing, a rotor mounted in the housing for rotation about a longitudinal axis, said rotor having an output shaft operatively connected thereto being coaxial with said longitudinal axis, a radial periphery and a plurality of piston chambers, a plurality of pistons disposed in said chambers, wherein each piston has a plurality of lateral surfaces meeting at an equal plurality of vertices to define a piston head, transfer means operatively associated with said pistons and said output shaft for transmitting force to said output shaft upon relative rotation between said pistons and said rotor, wherein the transfer means associated with each piston consist of a first operative pin and a second operative pin projecting axially from each piston head, and fluid delivery means in said housing for delivering a motive fluid to said chambers such that said fluid will effect relative rotation between said pistons and said rotor.

18. The apparatus of claim 17 wherein an axis passing perpendicularly through a central point on a transverse cross-section of said first operative pin is parallel to but not coaxial with the central axis of the piston and an axis passing through a central point on a transverse cross-section of the second operative pin and the central axis of the piston are coaxial.

19. The apparatus of claim 18 wherein the first operative pin projects axially from an end of the second operative pin.

20. The apparatus of claim 19 wherein a transverse cross-section of the first operative pin is completely enclosed within a transverse cross-section of the second operative pin.

21. The apparatus of claim 17 further including a receiving means attached to said housing, said receiving means having a reference surface and at least one guide track formed in said reference surface in which said transfer means are operatively engaged with said one track, said receiving means being fixed relative to said housing.

22. The apparatus of claim 21 wherein said receiving means includes a first guide track in engagement with said first operative pin.

23. The apparatus of claim 22 wherein said receiving means further includes a second guide track in engagement with said second operative pin.

24. The apparatus of claim 23 wherein said first guide track is laterally offset relative to said second guide track.

25. The apparatus of claim 22 wherein said first guide track has a width large enough such that the first operative pin fits within the width of the first track.

26. The apparatus of claim 23 wherein said second guide track has a width large enough such that the second operative pin fits within the width of the second guide track.

27. The apparatus of claim 26 wherein said second guide track has a depth in the receiving means less than the depth of the first track relative to said reference surface of the receiving means.

28. The apparatus of claim 27 wherein the first guide track and the second guide track operatively engage the first operative pin and the second operative pin respectively such that the pistons are prevented from rotating about their central axes as the pistons are translated along the tracks in said receiving means.

29. The apparatus of claim 28 wherein each guide track uniformly straddles a center line formed by th locus of points described by the central axes of the pistons as said pistons, without rotating about their central axes, are translated along a perimeter of a circle having a radius equal to the radius measured from the longitudinal axis of the output shaft to a point on the radially outermost arcuate surface of one of the piston chambers while at least one of the vertices of the piston had is always in contact with the circle and the cross-section of the piston head never crosses the perimeter of the circle.

30. The apparatus of claim 29 wherein the cross-sectional area of the piston chamber is defined by a locus of points described by the vertices of the piston head as the piston head is relatively rotated within a volume contained within the radial periphery of the rotor with the central axis of the piston parallel but not colinear with that of the longitudinal axis of the output shaft of the rotor and the rotor is rotated while the piston is not permitted to rotate but is allowed to translate along the center line of a guide track disposed at an axial end of the rotor and said guide track having a center lying on the longitudinal axis.

31. A non-reciprocating engine mechanism comprised of:

a housing, a rotor mounted in the housing for rotation about a longitudinal axis, said rotor having an output shaft operatively connected thereto being coaxial with said longitudinal axis, a radial periphery and a plurality of piston chambers, a plurality of pistons rotatably disposed in said chambers, transfer means operatively associated with said pistons and said output shaft for transmitting force to said output shaft upon relative rotation between said pistons and said rotor, and fluid delivery means in said housing for delivering a motive fluid to said chambers, wherein said fluid delivery means includes a thrust means positioned on an axial end of the rotor and said thrust means includes a plurality of involutes formed therein for delivering said motive fluid to the piston chambers, such that said fluid will effect relative rotation between said pistons and said rotor.

32. The apparatus of claim 31 wherein the involutes describe an angular section measured in the perpendicular plane to said longitudinal axis that is larger at the radial periphery of the thrust means than at an end point nearer the longitudinal axis.

33. The apparatus of claim 32 wherein there are thrust means at each axial end of the rotor and wherein the involutes are substantially parabolically shaped whereby as the rotor is rotated about said longitudinal axis, the involutes at a first axial end of the rotor are tangentially concave relative to rotation of the rotor and at a second axial end of the housing tangentially convex relative to rotation of the housing.

34. A non-reciprocating engine mechanism comprised of:

a housing having a plurality of openings allowing for motive fluids to be introduced into and removed from the housing, a rotor rotatably mounted in the housing for rotation about a longitudinal axis, said rotor having an output shaft operatively connected thereto being coaxial with said longitudinal axis, a plurality of piston chambers circumferentially disposed about said longitudinal axis said piston chambers having arcuate inner surfaces, and a radial periphery, a plurality of pistons each having a plurality of arcuate lateral surfaces meeting at an equal plurality of vertices, said lateral surfaces defining piston heads disposed in said chambers, and a central axis parallel but not colinear with the longitudinal axis of the rotor, transfer means extending axially from opposite ends of the pistons and being operatively associated with said pistons and said output shaft for transmitting force to said output shaft upon relative motion between said pistons and said rotor, receiving means attached to and fixed relative to said housing at opposite ends thereof, said receiving means having at least one guide track therein for receiving said transfer means, and delivery means in said housing for delivering a motive fluid such that said fluid will effect relative motion between said pistons and said rotor.

35. The apparatus of claim 34 wherein the transfer means associated with the pistons consist of at least one operative pin projecting axially from each axial end of the piston head.

36. The apparatus of claim 35 wherein the guide track operatively engages the operative pin such that the piston is prevented form rotating along the central axes of the pistons as the pistons are translated along the guide track.

37. The apparatus of claim 34 wherein the guide track uniformly straddles an associated center line formed by a locus of points described by the central axis of the pistons as the pistons are translated without rotating along a perimeter of a circle having a radius equal to the radius measured form the longitudinal axis to a point on the radially outermost arcuate surface of one of the piston chambers of the rotor and while at least one of the vertices of the piston head is always in contact with the circle and the cross-section of the piston head never crosses the perimeter of the circle.

38. The apparatus of claim 37 wherein the cross-sectional area of the piston chambers are defined by a locus of points described by the vertices of the piston head as the rotor is rotated while the piston is not permitted to rotate about the central axis of the piston but is allowed to translate along the center line of a guide track disposed at an axial end of the rotor and having a center lying on the longitudinal axis.

39. The apparatus of claim 34 wherein said fluid delivery means further includes a thrust means positioned on an axial end of the rotor.

40. A non-reciprocating engine mechanism comprised of:

a housing, a rotor mounted in the housing for rotation about a longitudinal axis, said rotor having an output shaft operatively connected thereto, and at least one piston chamber, a piston rotatably disposed in said chamber, said piston having a central axis parallel to said longitudinal axis, transfer means operatively associated with said pistons and said output shaft, wherein the transfer means associated with each piston consist of a first operative pin and a second operative pin projecting axially from each piston head, for transmitting force to said output shaft, and fluid delivery means in said housing for delivering a motive fluid to said chamber such that said fluid will effect relative rotation between said piston and said rotor.

41. The apparatus of claim 40 wherein an axis passing perpendicularly through a central point on a transverse cross-section of the second operative pin and the central axis of the piston are coaxial.

42. The apparatus of claim 41 wherein the first operative pin projects axially from an end of the second operative pin.

43. The apparatus of claim 42 wherein a transverse cross-section of the first operative pin is completely enclosed within a transverse cross-section of the second operative pin.

44. The apparatus of claim 43 further including a receiving means in attached to housing having a reference surface and at least one guide track formed in said reference surface of said receiving means and wherein said transfer means are operatively engaged with said one track, said receiving means being fixed relative to said housing.

45. The apparatus of claim 44 wherein said receiving means includes a first guide track and said first guide track is in engagement with said first operative pin.

46. The apparatus of claim 45 wherein said receiving means includes a second guide track, said second guide track being in operative engagement with said second operative pin.

47. The apparatus of claim 46 wherein said first guide track is laterally offset relative to said second guide track.

48. The apparatus of claim 46 wherein said first guide track has a width large enough such that the first operative pin fits within the width of the first track.

49. The apparatus of claim 46 wherein said second guide track has a width large enough such that the second operative pin fits within the width of the second guide track.

50. The apparatus of claim 49 wherein said second guide track has a depth in the receiving means which is less than the depth of the first track relative to said reference surface of the receiving means.

51. The apparatus of claim 50 wherein the first guide track and the second guide track operatively engage the first operative pin and the second operative pin respectively such that the pistons are prevented form rotating about their central axes as the pistons are translated along the tracks in said receiving means.

52. A non-reciprocating engine mechanism comprised of:

a housing, a rotor mounted in the housing for rotation about a longitudinal axis, said rotor having an output shaft operatively connected thereto, and at least one piston chamber, a piston disposed in said chamber having lateral surfaces which meet at a plurality of vertices and a central axis, said lateral surfaces defining the sides of a piston head, said piston being translatable in a plane perpendicular to said longitudinal axis while maintaining a constant orientation in said plane as the rotor is rotated about said longitudinal axis, transfer means operatively associated with said piston and said output shaft for transmitting force to said output shaft, and fluid delivery means in said housing for delivering a motive fluid to said chamber such that said fluid will effect relative motion between said piston and said rotor.

53. The apparatus of claim 52 wherein said fluid delivery means includes at least one opening through which motive fluids are introduced to and removed from said chambers.

54. The apparatus of claim 53 where the housing has at least one opening allowing the output shaft to pass through the housing.

55. A non-reciprocating engine mechanism comprised of:

a housing wherein the housing has at least one opening allowing an output shaft to pass through the housing, a rotor mounted in the housing for rotation about a longitudinal axis, said rotor having an output shaft operatively connected thereto, and at least one piston chamber, a piston rotatably disposed in said chamber having lateral surfaces which meet at a plurality of vertices, said lateral surfaces defining the sides of a piston head, transfer means operatively associated with said piston and said output shaft for transmitting force to said output shaft, fluid delivery means in said housing for delivering a motive fluid to said chamber wherein said fluid delivery means includes at least one opening through which motive fluids are introduced to and removed from said chambers, such that said fluid will effect relative rotation between said piston and said rotor, and a receiving means attached to and fixed relative to said housing having a reference surface and at least one guide track formed in the reference surface of said receiving means wherein said transfer means are operatively engaged with said one track, said receiving means being fixed relative to said housing.

56. The apparatus of claim 55 wherein the guide track operatively engages the transfer means such that the piston is prevented from rotating about its central axis as the piston is translated along the track in said receiving means.

57. The apparatus of claim 56 wherein said rotor rotates about said longitudinal axis.

58. The apparatus of claim 57 wherein said piston chamber has arcuate inner surfaces.

59. The apparatus of claim 58 where a radially outermost arcuate inner surface of the piston chamber has an arc radii equal to a distance measured along a radius from the longitudinal axis to a point on the radially outermost arcuate surface of the piston chamber.

60. A non-reciprocating engine mechanism comprised of:

a housing, wherein the housing has at least one opening allowing an output shaft to pass through the housing, a rotor mounted in the housing for rotation about a longitudinal axis, said rotor having said output shaft operatively connected thereto and having at least one piston chamber disposed therein, said piston chamber having arcuate inner surfaces, wherein a radially outermost arcuate inner surface of the piston chamber has an arc radii equal to a distance measured along a radius from the longitudinal axis to a point on the radially outermost arcuate surface of the piston chamber, wherein said rotor rotates about said longitudinal axis, a piston rotatably disposed in said chamber having lateral surfaces which meet at a plurality of vertices, said lateral surfaces defining the sides of a piston head, and a central axis passing through a center of the piston head, said central axis being parallel with the longitudinal axis of the rotor, transfer means operatively associated with said piston and said output shaft for transmitting force to said output shaft, said transfer means including a first operative pin and a second operative pin extending axially from said piston head, fluid delivery means in said housing for delivering a motive fluid to said chamber, wherein said fluid delivery means includes at least one opening through which motive fluids are introduced to and removed from said chambers, such that said fluid will effect relative rotation between said piston and said rotor, and a receiving means attached to and fixed relative to said housing, said receiving means having a reference surface and a first guide track and a second guide track formed in the reference surface of said receiving means, wherein the first guide track and the second guide track uniformly straddle center lines formed by a locus of points described by the central axis of the piston as the piston is translated without rotating about the central axis along a perimeter of a circle having a radius equal tot he radius measured for the longitudinal axis to a point on the outermost arcuate surface of the piston chamber while at least one of the vertices of the piston head is always in contact with the circle and the cross-section of the piston had never crosses the perimeter of the circle and said first operative pin and second operative pin operatively engage said first guide track and said second guide track, respectively, such that the piston is prevented from rotating about its central axis as the piston is translated along the tracks in said receiving means.

61. The apparatus of claim 60 wherein the cross-sectional area of the piston chamber is defined by a locus of points described by the vertices of the piston head as the piston head is relatively rotated within a volume contained within the periphery of the rotor with the axis of the piston parallel but not colinear with that of the longitudinal axis of the rotor and the rotor is rotated while the piston is not permitted to rotate but is allowed to translate along the center line of a guide track disposed at an axial end of the rotor and said guide track having a center lying on the longitudinal axis.

62. A method of producing motive power comprising the steps of:

providing a housing, providing a rotor mounted in the housing for rotation about a longitudinal axis, said rotor having an output shaft operatively connected thereto, a radial periphery, and a plurality of piston chambers having inner surfaces, providing a plurality of pistons disposed in each of said piston chambers, said pistons having a central axis parallel to said longitudinal axis of the rotor, and being translatable in a plane perpendicular to said longitudinal axis while maintaining a constant orientation in said plane as the rotor is rotated about said longitudinal axis, providing fluid delivery means for delivering a motive fluid to said chambers, providing transfer means operatively associated with said pistons and said output shaft for transmitting force to said output shaft, providing at least one receiving means attached to and fixed relative to said housing which does not rotate about the longitudinal axis of the rotor and is operable to receive reactive forces transmitted by said transfer means, and expanding the motive fluids between each piston and the chamber in which it is disposed to effect relative motion between said rotor and the pistons, and converting the reactive forces transmitted by said transfer means to the receiving surface into torque delivered through the output shaft.

63. The method of claim 62 further comprising the step of transmitting torque to said output shaft by shaping the receiving means and the transfer means so that reactive forces transmitted between said receiving means and said transfer means is directed to cause the rotor to rotate about the longitudinal axis.

64. The method of claim 62 further comprising the step of providing a piston chamber having a radially non-uniform cross-section.

65. The method of claim 64 further comprising the step of expanding the motive fluids between faces of the piston heads and the inner surfaces of the piston chamber at an asymmetrical rate.

66. The method of claim 62 further comprising the step of shaping the fluid delivery means to exploit the rotation of the rotor to cause the motive fluids to be compressed into the piston chambers prior to the expanding of said motive fluids.

67. The method of claim 62 further comprising the step of shaping the fluid delivery means to exploit the rotation of the rotor to cause the motive fluids to be extracted from the piston chambers after the expanding of said motive fluids.

* * * * *